US011235213B2

(12) United States Patent
Tsuji

(10) Patent No.: US 11,235,213 B2
(45) Date of Patent: Feb. 1, 2022

(54) GOLF CLUB HEAD AND GOLF CLUB

(71) Applicant: MIZUNO CORPORATION, Osaka (JP)

(72) Inventor: Kei Tsuji, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 16/910,376

(22) Filed: Jun. 24, 2020

(65) Prior Publication Data

US 2020/0406111 A1 Dec. 31, 2020

(30) Foreign Application Priority Data

Jun. 26, 2019 (JP) ..... JP2019-118739

(51) Int. Cl.
*A63B 53/04* (2015.01)
*A63B 53/06* (2015.01)
*A63B 53/08* (2015.01)

(52) U.S. Cl.
CPC ..... *A63B 53/06* (2013.01); *A63B 53/04* (2013.01); *A63B 53/0433* (2020.08); (Continued)

(58) Field of Classification Search
CPC ..... A63B 53/06; A63B 53/0433; A63B 53/04; A63B 2053/0491
See application file for complete search history.

(56) References Cited

U.S. PATENT DOCUMENTS 9,682,298 B1 * 6/2017 Kingston ..... A63B 60/52
9,707,459 B1 * 7/2017 Myers ..... A63B 60/52
(Continued)

FOREIGN PATENT DOCUMENTS

JP 2008005912 A 1/2008
JP 2010252964 A 11/2010
(Continued)

OTHER PUBLICATIONS

Extended European Search Report dated Nov. 3, 2020 issued in European Patent Application No. 20182128.7.
(Continued)

*Primary Examiner* — John E Simms, Jr.
(74) *Attorney, Agent, or Firm* — Troutman Pepper Hamilton Sanders LLP; James E. Schutz; Micah B. Hensley

(57) ABSTRACT

A golf club head includes a main body and a weight attached to and detached from the main body. The main body includes a face having a ball striking face, and a sole having a sole surface brought into contact with the ground when striking a ball. The sole has formed thereon a first guide track recessed with respect to the sole surface and having a longitudinal direction and a lateral direction in a plan view. The weight is fixed inside the first guide track. The first guide track includes an attachment/detachment region in which the weight is attached/detached, and a first fixing region and a second fixing region in which the weight is moved in the longitudinal direction and fixed. The first fixing region and the second fixing region are disposed to be contiguous to the attachment/detachment region in the longitudinal direction and sandwich the attachment/detachment region.

4 Claims, 6 Drawing Sheets

(52) U.S. Cl.
CPC ..... *A63B 53/0466* (2013.01); *A63B 53/08* (2013.01); *A63B 2053/0491* (2013.01)

(56) References Cited

U.S. PATENT DOCUMENTS

| | | | | |
|---|---|---|---|---|
| 10,086,240 | B1 * | 10/2018 | Hoffman | A63B 53/0466 |
| 10,188,916 | B2 | 1/2019 | Harbert et al. | |
| 2006/0122004 | A1 * | 6/2006 | Chen | A63B 53/0466 473/335 |
| 2007/0298906 | A1 | 12/2007 | Oyama | |
| 2008/0194354 | A1 * | 8/2008 | Nagai | A63B 60/52 473/334 |
| 2008/0261715 | A1 * | 10/2008 | Carter | A63B 60/00 473/291 |
| 2011/0009209 | A1 * | 1/2011 | Llewellyn | A63B 60/02 473/336 |
| 2014/0080627 | A1 * | 3/2014 | Bennett | A63B 60/54 473/332 |
| 2015/0297961 | A1 * | 10/2015 | Voshall | A63B 53/06 473/335 |
| 2015/0321055 | A1 * | 11/2015 | Golden | A63B 60/42 473/338 |
| 2016/0001146 | A1 | 1/2016 | Sargent et al. | |
| 2016/0051869 | A1 * | 2/2016 | Foster | A63B 53/0466 473/335 |
| 2016/0375326 | A1 * | 12/2016 | Nunez | A63B 60/04 473/335 |
| 2018/0178092 | A1 * | 6/2018 | Johnson | A63B 60/50 |
| 2018/0345093 | A1 * | 12/2018 | Harbert | A63B 53/0466 |
| 2019/0224812 | A1 | 7/2019 | Abitz et al. | |

FOREIGN PATENT DOCUMENTS

| | | | |
|---|---|---|---|
| JP | 2015205173 | A | 11/2015 |
| JP | 2018167064 | A | 11/2018 |
| JP | 2019017805 | A | 2/2019 |
| WO | 2019035912 | A1 | 2/2019 |

OTHER PUBLICATIONS

Japanese Office Action dated May 11, 2021 issued in Japanese Patent Application No. 2019-118739.

* cited by examiner

GOLF CLUB HEAD AND GOLF CLUB

This nonprovisional application is based on Japanese Patent Application No. 2019-118739 filed on Jun. 26, 2019 with the Japan Patent Office, the entire contents of which are hereby incorporated by reference.

BACKGROUND OF THE INVENTION

Field of the Invention

The present invention relates to a golf club head and a golf club.

Description of the Background Art

Currently, there has been proposed a golf club head adjustable by a user to have his/her desired characteristics. For example, Japanese Patent Laying-Open No. 2015-205173 proposes a golf club head capable of adjusting its center of gravity by adjusting whether a weight is present/absent in three tracks provided on the sole of the golf club head and where the weight is positioned when it is present. In the golf club head, the tracks have an open end in a direction in which the tracks extend to allow the weight to be attached to and detached from the tracks.

SUMMARY OF THE INVENTION

A golf club head has its center of gravity adjusted in a range, which is maximized in a configuration in which a weight can be fixed at opposite ends of a track in a direction in which the track extends.

In the above golf club head, however, the track has an open end in the direction in which the track extends, and a weight cannot be fixed at that end. Accordingly, in the above golf club head, a position at which the weight is fixed can only be changed in the direction in which the track extends along a length shorter than an entire length of the track in the direction in which the track extends. As a result, the golf club head has its center of gravity adjusted in a range which is narrower than that when a weight can be fixed at the opposite ends of the track in the direction in which the track extends.

A main object of the present invention is to provide a golf club head having a center of gravity adjusted in a wider range than a conventional golf club head, and a golf club including the same.

A golf club head according to the present invention includes a main body and at least one weight attached to and detached from the main body. The main body includes a face having a ball striking face, and a sole connected to the face and having a sole surface brought into contact with the ground when striking a ball. The sole has formed thereon at least one guide track recessed with respect to the sole surface and having a longitudinal direction and a lateral direction in a plan view. At least one weight is fixed inside the at least one guide track. The at least one guide track includes an attachment/detachment region in which the at least one weight is moved in a depthwise direction with respect to the sole surface and attached/detached, and first and second fixing regions in which the at least one weight is moved in the longitudinal direction and fixed. The first and second fixing regions are disposed to be continuous to the attachment/detachment region in the longitudinal direction and also sandwich the attachment/detachment region. The first fixing region has one end of the at least one guide track in the longitudinal direction. The second fixing region has the other end of the at least one guide track in the longitudinal direction.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, an embodiment of the present invention will be described with reference to the drawings. In the figures, identical or corresponding components will be identically denoted and will not be described repeatedly.

Figure 1:
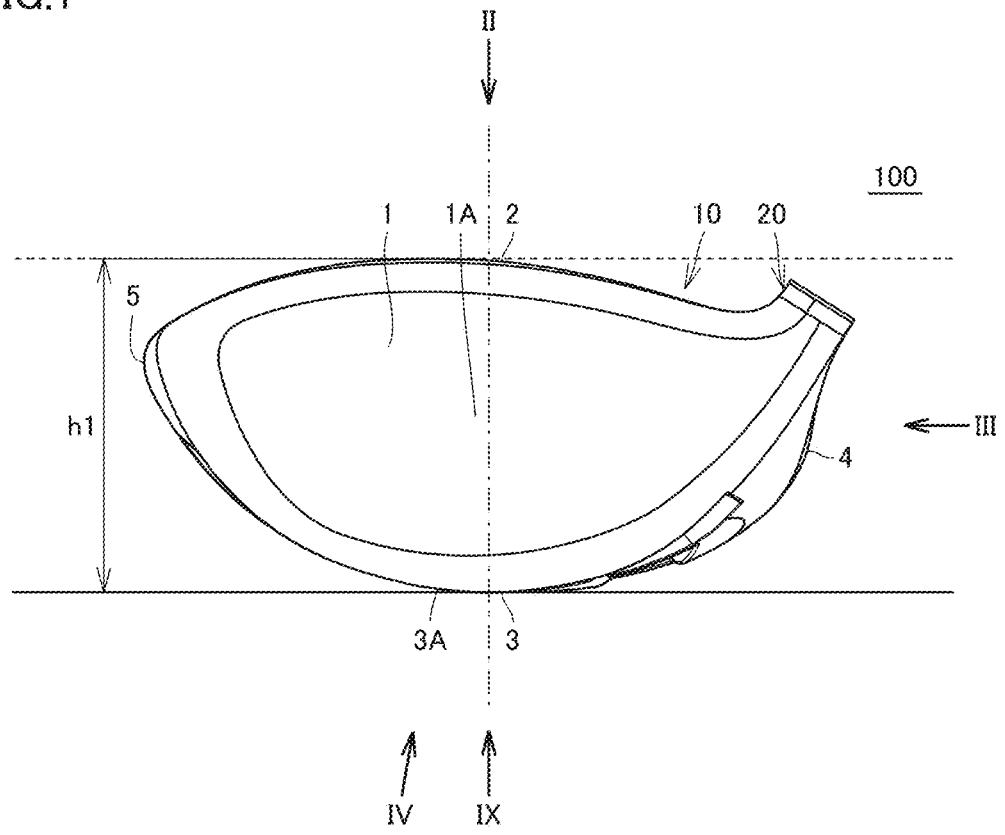
FIG. 1 is a front view of a golf club head according to an embodiment.
Figure 2:
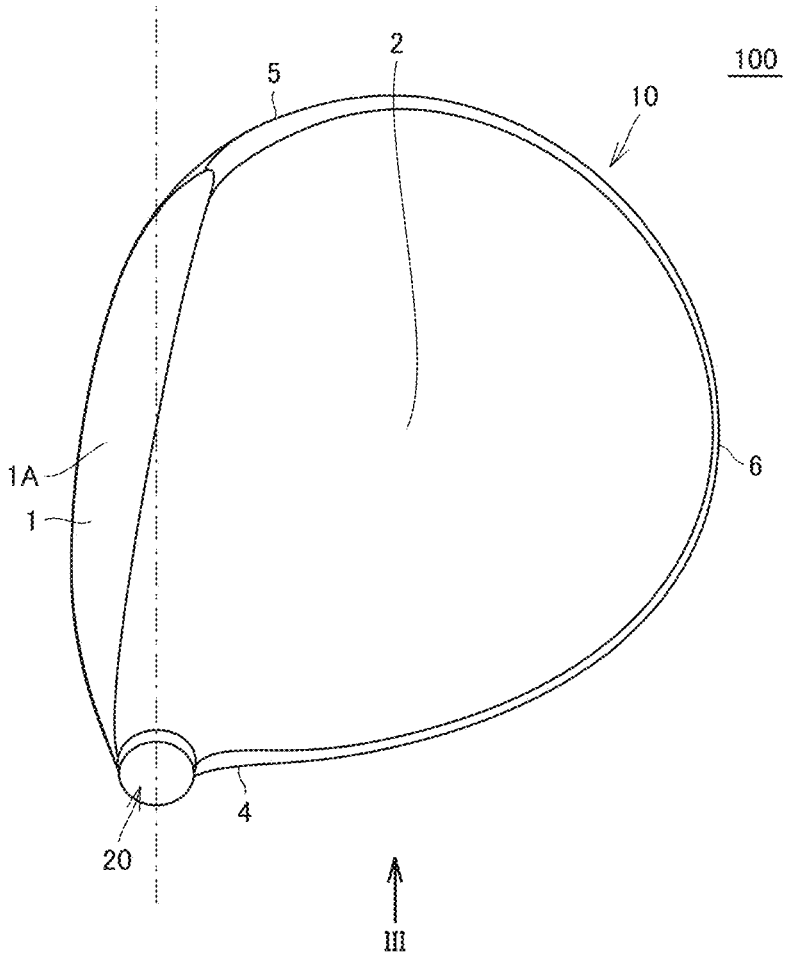
FIG. 2 is a plan view seen along an arrow II indicated in FIG. 1.
Figure 3:
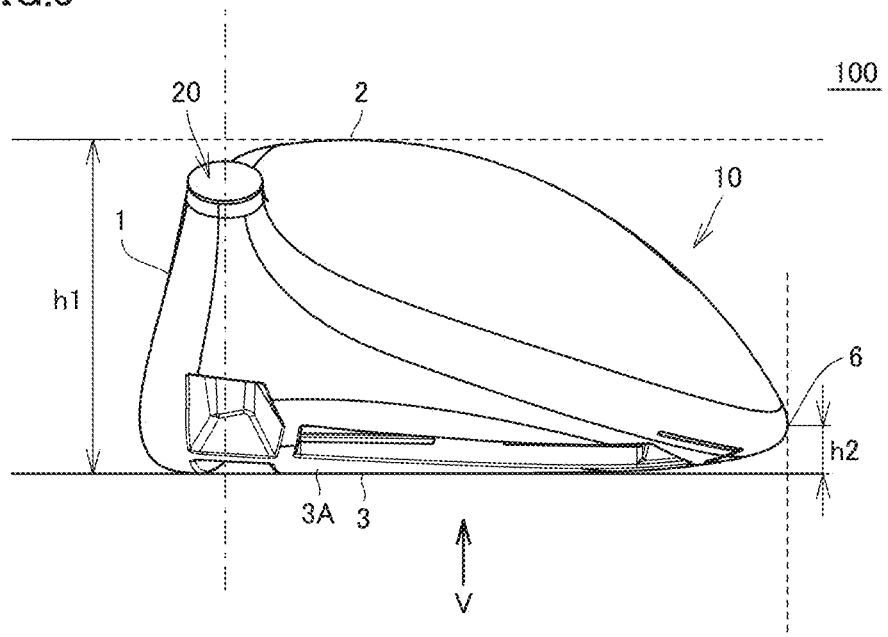
FIG. 3 is a side view seen along an arrow III indicated in FIG. 1.

A configuration of a golf club head 100 according to the present embodiment will be described with reference to FIGS. 1 to 9. Golf club head 100 shown in FIGS. 1 to 9 is configured as a wood type golf club head as an example of the present embodiment. FIGS. 1 and 3 show golf club head 100 placed on a horizontal plane so as to form loft and lie angles as predetermined (hereinafter also referred to as "the placed state").

As shown in FIGS. 1 to 4, golf club head 100 mainly includes a main body 10, a hosel 20, and a plurality of weights 30.

Main body 10 includes a face 1, a crown 2, a sole 3, a heel 4, a toe 5, and a back 6. Hosel 20 is configured integrally with main body 10. A club shaft 110 is connected to hosel 20 in a golf club 200 described hereinafter. The plurality of weights 30 are each configured to be discrete from main body 10 and attached to and detached from main body 10. Main body 10 and hosel 20 are formed for example of stainless steel. Each weight 30 is formed for example of stainless steel, titanium, or tungsten. The plurality of weights 30 are equivalently configured for example.

Face 1 has a ball striking face 1A. Face 1 has a sweet spot on ball striking face 1A. A sweet area is formed around the sweet spot on ball striking face 1A of face 1. A plurality of score lines (not shown) may be formed on ball striking face 1A.

Crown 2 is a portion that constitutes an upper portion of golf club head 100. Crown 2 is contiguous to face 1. Sole 3 is a portion that constitutes a bottom portion of golf club head 100. Sole 3 has a sole surface 3A that is brought into contact with the ground when striking a ball. Sole surface 3A is a curved surface. Sole 3 is contiguous to face 1. Heel 4 is a portion extending from a lower end of hosel 20 to sole 3. Heel 4 is contiguous to face 1. Toe 5 is a portion that interconnects crown 2 and sole 3 on a side away from hosel 20. Toe 5 is contiguous to face 1. A direction in which heel 4 and toe 5 are connected is a toe-heel direction. Back 6 faces away from ball striking face 1A and is located at a position farthest from ball striking face 1A in a direction perpendicular to ball striking face 1A.

As shown in FIG. 3, back 6 is a portion at which crown 2 and sole 3 located at a position farthest from ball striking face 1A in the direction perpendicular to ball striking face 1A are smoothly interconnected. In the placed state indicated above, a height h2 of back 6 with respect to the horizontal plane is smaller than half a maximum height h1 of golf club head 100 with respect to the horizontal plane. From a different point of view, golf club head 100 is a golf club head having a so-called shallow back shape.

As shown in FIGS. 4 to 9, sole 3 has a first guide track 7 formed thereon. First guide track 7 is recessed with respect to sole surface 3A of sole 3. First guide track 7 has a longitudinal direction and a lateral direction in a plan view. The longitudinal direction of first guide track 7 is along a direction intersecting with ball striking face 1A. Weight 30 is accommodated in and attached to and detached from first guide track 7. Note that weight 30 is not shown in FIGS. 8 and 9.

As shown in FIGS. 4 to 8, first guide track 7 includes a first inner peripheral surface 71, a second inner peripheral surface 72, a third inner peripheral surface 73 and a fourth inner peripheral surface 74, and a bottom surface 75. First inner peripheral surface 71 and second inner peripheral surface 72 extend in the longitudinal direction and face each other in the lateral direction. First inner peripheral surface 71 is located closer to toe 5 than second inner peripheral surface 72 is. Third inner peripheral surface 73 and fourth inner peripheral surface 74 extend in the lateral direction and face each other in the longitudinal direction. Third inner peripheral surface 73 is located closer to face 1 than fourth inner peripheral surface 74 is.

Figure 4:
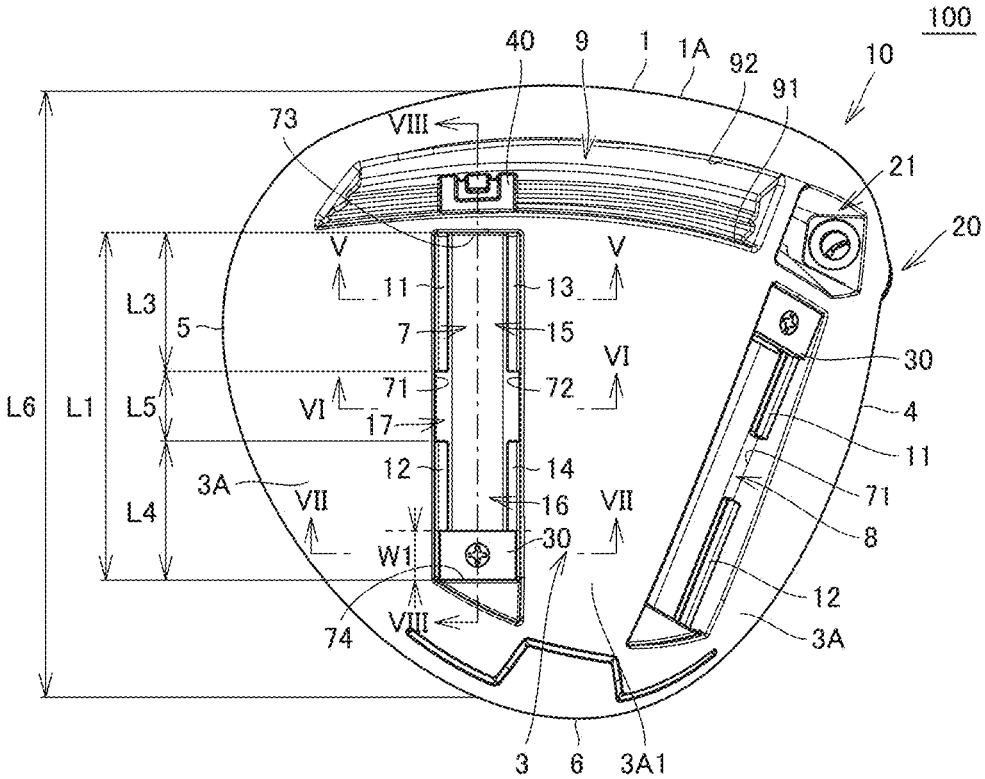
FIG. 4 is a bottom view seen along an arrow IV indicated in FIG. 1.
Figure 5:
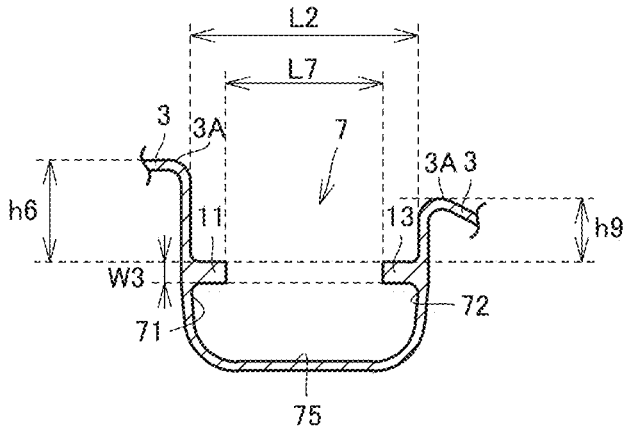
FIG. 5 is a cross section as seen along an arrow V-V indicated in FIG. 4.
Figure 7:
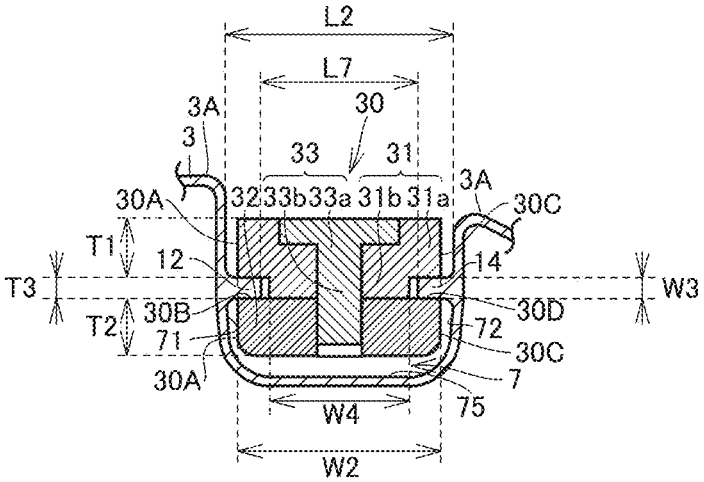
FIG. 7 is a cross section as seen along an arrow VII-VII indicated in FIG. 4.

As shown in FIGS. 4, 5 and 7, first guide track 7 further has a first protrusion 11, a second protrusion 12, a third protrusion 13, and a fourth protrusion 14. First protrusion 11 and second protrusion 12 are connected to first inner peripheral surface 71 and protrude with respect to first inner peripheral surface 71. Third protrusion 13 and fourth protrusion 14 are connected to second inner peripheral surface 72 and protrude with respect to second inner peripheral surface 72. First protrusion 11, second protrusion 12, third protrusion 13, and fourth protrusion 14 extend in the longitudinal direction. First and second protrusions 11 and 12 and third and fourth protrusions 13 and 14 are for example symmetrical with respect to an imaginary line connecting a center between first inner peripheral surface 71 and second inner peripheral surface 72.

Figure 8:
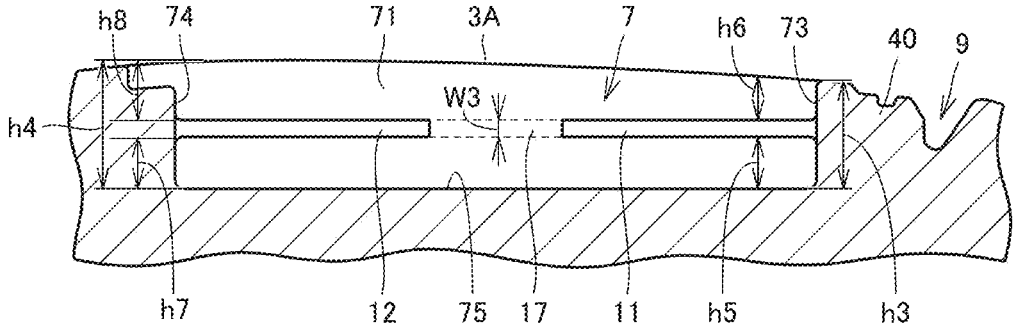
FIG. 8 is a cross section as seen along an arrow VIII-VIII indicated in FIG. 4.

As shown in FIGS. 4 and 8, second protrusion 12 is spaced from first protrusion 11 in the longitudinal direction. First protrusion 11 and second protrusion 12 are formed to extend in the same straight line. Fourth protrusion 14 is spaced from third protrusion 13 in the longitudinal direction. Third protrusion 13 and fourth protrusion 14 are formed to extend in the same straight line.

As shown in FIGS. 4 and 8, first protrusion 11 in the longitudinal direction has an end connected to third inner peripheral surface 73. First protrusion 11 in the longitudinal direction has the other end spaced from one end of second protrusion 12 in the longitudinal direction. Second protrusion 12 in the longitudinal direction has the other end connected to fourth inner peripheral surface 74.

Third protrusion 13 in the longitudinal direction has one end connected to third inner peripheral surface 73. Third protrusion 13 in the longitudinal direction has the other end spaced from one end of fourth protrusion 14 in the longitudinal direction. Fourth protrusion 14 in the longitudinal direction has the other end connected to fourth inner peripheral surface 74.

As shown in FIGS. 4 to 7, First guide track 7 in the longitudinal direction may have a length L1 (see FIG. 4), that is, a length between third inner peripheral surface 73 and fourth inner peripheral surface 74, larger than a length L2 of first guide track 7 in the lateral direction (see FIGS. 5 to 7), that is, a length between first inner peripheral surface 71 and second inner peripheral surface 72.

As shown in FIG. 4 the length L1 is equal to a sum of a length L3 of first protrusion 11 in the longitudinal direction, a length L4 of second protrusion 12 in the longitudinal direction, and a distance L5 in the longitudinal direction between first protrusion 11 and second protrusion 12.

The length L3 of first protrusion 11 is equal to a length of third protrusion 13 in the longitudinal direction. The length L4 of second protrusion 12 is equal to a length of fourth protrusion 14 in the longitudinal direction. The length L3 of first protrusion 11 is equal to the length L4 of second protrusion 12. The length of third protrusion 13 in the longitudinal direction is equal to the length of fourth protrusion 14 in the longitudinal direction.

As shown in FIGS. 4 and 7, the distance L5 in the longitudinal direction between first protrusion 11 and second protrusion 12 is smaller than the length L3 of first protrusion 11 and the length 4 of second protrusion 12. The length L1 is equal to three times the distance L5 or larger. The distance L5 is equal to a distance in the longitudinal direction between third protrusion 13 and fourth protrusion 14.

As shown in FIGS. 4, 5 and 7, a distance L7 in the lateral direction between first protrusion 11 and third protrusion 13 is smaller than the length L2. A distance in the lateral direction between second protrusion 12 and fourth protrusion 14 is smaller than the length L2. The distance L7 in the lateral direction between first protrusion 11 and third protrusion 13 is equal to the distance in the lateral direction between second protrusion 12 and fourth protrusion 14, for example. The distance L7 is fixed in the longitudinal direction.

Figure 6:
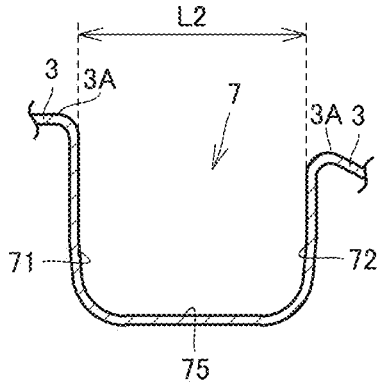
FIG. 6 is a cross section as seen along an arrow VI-VI indicated in FIG. 4.

As shown in FIGS. 5 to 7, a depth of bottom surface 75 with respect to sole surface 3A on the side of first inner peripheral surface 71 is deeper than a depth of bottom surface 75 with respect to sole surface 3A on the side of second inner peripheral surface 72, for example.

As shown in FIG. 8, a depth h3 of bottom surface 75 with respect to sole surface 3A on the side of third inner peripheral surface 73 is shallower than a depth h4 of bottom surface 75 with respect to sole surface 3A on the side of fourth inner peripheral surface 74. The depth h3 is equal to a sum of a distance h5 between first protrusion 11 and bottom surface 75, a width W3 of first protrusion 11, and a distance h6 between first protrusion 11 and sole surface 3A in a depthwise direction with respect to sole surface 3A. The depth h4 is equal to a sum of a distance h7 between second protrusion 12 and bottom surface 75, a width of second protrusion 12, and a distance h8 between second protrusion 12 and sole surface 3A in the depthwise direction with respect to sole surface 3A.

As shown in FIG. 8, the distance h5 between first protrusion 11 and bottom surface 75 is equal to the distance h7 between second protrusion 12 and bottom surface 75. The distance h5 and the distance h7 are fixed in the longitudinal direction.

As shown in FIG. 5, first protrusion 11 has thickness W3 equal to that of third protrusion 13. As shown in FIG. 7, second protrusion 12 has thickness W3 equal to that of fourth protrusion 14. As shown in FIG. 8, first protrusion 11 has thickness W3 equal to that of second protrusion 12.

As shown in FIG. 8, the distance h6 in the depthwise direction between first protrusion 11 and sole surface 3A is smaller the distance h8 in the depthwise direction between second protrusion 12 and sole surface 3A.

The length L1 is larger than a first width W1 of weight 30 in the longitudinal direction (see FIG. 4). The length L3, the length L4, and the distance L5 are each larger than or equal to the first width W1 of weight 30 in the longitudinal direction (see FIG. 4). That is, the length L1 equal to three times the first width W1 of weight 30 or larger. The length L1 is, for example, equal to or larger than a half of a width L6 of main body 10 on an imaginary line connecting a center between first inner peripheral surface 71 and second inner peripheral surface 72 (see FIG. 4), that is, a half of a distance between one end of sole 3 and the other end of sole 3 on that imaginary line segment. Preferably, the length L1 is larger than half the width L6. The length L2 is equal to or larger than a second width W2 of weight 30 in the lateral direction (see FIG. 7). The distance L7 is smaller than the second width W2 of weight 30.

From a different point of view, first guide track 7 includes a first fixing region 15, a second fixing region 16, and an attachment/detachment region 17. First fixing region 15 has first protrusion 11 and third protrusion 13. Second fixing region 16 has second protrusion 12 and fourth protrusion 14. Attachment/detachment region 17 is a region located between first fixing region 15 and second fixing region 16 in the longitudinal direction. That is, first fixing region 15 and second fixing region 16 are contiguous to attachment/detachment region 17 in the longitudinal direction and also sandwich attachment/detachment region 17 in the longitudinal direction. Attachment/detachment region 17 in the lateral direction has a distance equal to or larger than the second width W2 of weight 30. First fixing region 15 and second fixing region 16 are regions in which weight 30 is moved in the longitudinal direction and fixed. First fixing region 15 and second fixing region 16 restrict movement of weight 30 in the depthwise direction. Attachment/detachment region 17 is a region in which weight 30 is moved in the depthwise direction and attached and detached.

When weight 30 is attached in first guide track 7, weight 30 has a first outer peripheral surface 30A facing first inner peripheral surface 71, a first recess 30B recessed with respect first outer peripheral surface 30A and extending in the longitudinal direction, a second outer peripheral surface 30C facing second inner peripheral surface 72, and a second recess 30D recessed with respect to second outer peripheral surface 30C and extending in the longitudinal direction.

As shown in FIG. 7, weight 30 includes an upper portion 31, a bottom portion 32, and a screw 33. Upper portion 31 and bottom portion 32 are stacked in layers in the depthwise direction with respect to sole surface 3A with first and third protrusions 11 and 13 or second and fourth protrusions 12 and 14 posed therebetween. A through hole is formed through upper portion 31 and bottom portion 32. Screw 33 is inserted into and fixed to the through hole to fix upper portion 31 and bottom portion 32 that are stacked in layers to first guide track 7.

Specifically, screw 33 includes a head 33*a* and a screw shaft 33*b*. Head 33*a* is larger in diameter than screw shaft 33*b*. In the above stacked state, screw shaft 33*b* extends in the depthwise direction with respect to sole surface 3A. Screw shaft 33*b* is externally threaded.

Upper portion 31 has formed therein a first through hole that accommodates head 33*a* and a second through hole that is connected to the first through hole and receives a portion of screw shaft 33*b*. Upper portion 31 has a first portion 31*a* and a second portion 31*b* aligned in a direction in which the first and second through holes extend. First portion 31*a* and second portion 31*b* are integrally formed. As shown in FIG. 7, in a third direction intersecting with the direction in which the first and second through holes extend, upper portion 31 has first portion 31*a* with width W2 larger than a width W4 of second portion 31*b* of upper portion 31.

Bottom portion 32 has a third through hole formed therein to receive another portion of screw shaft 33*b*. The third through hole formed in bottom portion 32 is internally threaded to be engagable with screw shaft 33*b* that is externally threaded. A width of bottom portion 32 in the third direction is larger than the width W4 of second portion 31*b* of upper portion 31. An outer peripheral surface of first portion 31*a* of upper portion 31 and that of bottom portion 32 that are directed in the third direction constitute the first outer peripheral surface 30A of weight 30. An outer peripheral surface of second portion 31*b* of upper portion 31 that is directed in the third direction constitutes a bottom surface of first recess 30B of weight 30.

As shown in FIGS. 7 and 8, a thickness T1 of first portion 31*a* of upper portion 31 in the direction in which the first and second through holes extend is smaller than or equal to the distance h6 between first protrusion 11 and sole surface 3A. A thickness T2 of bottom portion 32 in the direction in which the first and second through holes extend is equal to or smaller than the distance h5 between first protrusion 11 and bottom surface 75. That is, weight 30 has its entirety accommodated inside first guide track 7 regardless of where weight 30 is fixed inside first guide track 7.

In a fourth direction that intersects with the direction in which the first and second through holes extend and also intersects with the third direction, first portion 31*a* of upper portion 31 and bottom portion 32 are equal in width to second portion 31*b* of upper portion 31 for example.

When weight 30 is accommodated in and fixed to first guide track 7 of main body 10, the third direction extends in the lateral direction of first guide track 7 of golf club head 100, and the fourth direction extends in the longitudinal direction of first guide track 7 of golf club head 100. That is, the width of first portion 31*a* of upper portion 31 and bottom portion 32 in the fourth direction is the first width W1 of weight 30. The width of first portion 31*a* of upper portion 31 and bottom portion 32 in the third direction is the second width W2 of weight 30.

The width W4 of second portion 31*b* of upper portion 31 is smaller than the distance L7 in the lateral direction between first protrusion 11 and third protrusion 13 and a distance in the lateral direction between second protrusion 12 and fourth protrusion 14. A distance T3 between upper portion 31 and bottom portion 32 in the direction in which the first and second through holes extend varies with how much screw 33 is tightened. When screw 33 is loosened, the distance T3 between upper portion 31 and bottom portion 32 is increased to be larger than the width W3 of first protrusion 11, second protrusion 12, third protrusion 13, and fourth protrusion 14 in the depthwise direction. While in this state weight 30 is restricted in movement in the depthwise direction, it can move in the longitudinal direction with respect to first guide track 7. When screw 33 is tightened, the distance T3 between upper portion 31 and bottom portion 32 is equal to or smaller than the width W3. In this state, weight 30 is fixed to first guide track 7.

When fixing weight 30 in first guide track 7, initially, weight 30 is prepared with upper portion 31 and bottom portion 32 connected together by screw 33. In weight 30, screw 33 is loosened with respect to bottom portion 32. The distance between upper portion 31 and bottom portion 32 in weight 30 is larger than the width of first and third protrusions 11 and 13 in the depthwise direction or the width between second protrusion 12 and fourth protrusion 14 in the depthwise direction. Subsequently, weight 30 is accommodated in attachment/detachment region 17 of first guide track 7. Subsequently, weight 30 is moved from attachment/detachment region 17 in the longitudinal direction and positioned in first guide track 7 at either first fixing region 15 or second fixing region 16. Specifically, upper portion 31 and bottom portion 32 are disposed at a position to face each other with first and third protrusions 11 and 13 or second and fourth protrusions 12 and 14 interposed, and screw 33 is tightened. As a result, upper portion 31 and bottom portion 32 are brought into contact with first and third protrusions 11 and 13 or second and fourth protrusions 12 and 14 at the same time, and weight 30 is thus fixed to first guide track 7.

When weight 30 is moved again with respect to first guide track 7, screw 33 is loosened. Accordingly, the distance between upper portion 31 and bottom portion 32 in a direction in which screw shaft 33*b* of screw 33 extends is increased to be larger than the width of first and third protrusions 11 and 13 in the depthwise direction or that of second and fourth protrusions 12 and 14 in the depthwise direction, and weight 30 can move in the longitudinal direction with respect to first guide track 7. When weight 30 is moved from first fixing region 15 or second fixing region 16 to attachment/detachment region 17, weight 30 can move in the depthwise direction and can be removed from first guide track 7.

In this way, weight 30 can be attached to and detached from first guide track 7 while upper portion 31 and bottom portion 32 are connected together by screw 33.

As shown in FIGS. 4 to 9, golf club head 100 has sole 3 with first guide track 7, and in addition, a second guide track 8, a first track 9, and a second track 21 formed thereon. First guide track 7, second guide track 8, first track 9, and second track 21 are spaced from one another.

Second guide track 8 is recessed with respect to sole surface 3A of sole 3. Second guide track 8 has a longitudinal direction and a lateral direction in a plan view. The longitudinal direction of second guide track 8 extends in a direction that intersects with the longitudinal direction of first guide track 7 and also intersects with ball striking face 1A. Second guide track 8 is spaced from first guide track 7 in the toe-heel direction. Second guide track 8 is located closer to heel 4 than first guide track 7 is. A distance between first guide track 7 and second guide track 8 in the toe-heel direction gradually decreases as the tracks are farther away from ball striking face 1A in the direction intersecting with ball striking face 1A.

Figure 9:
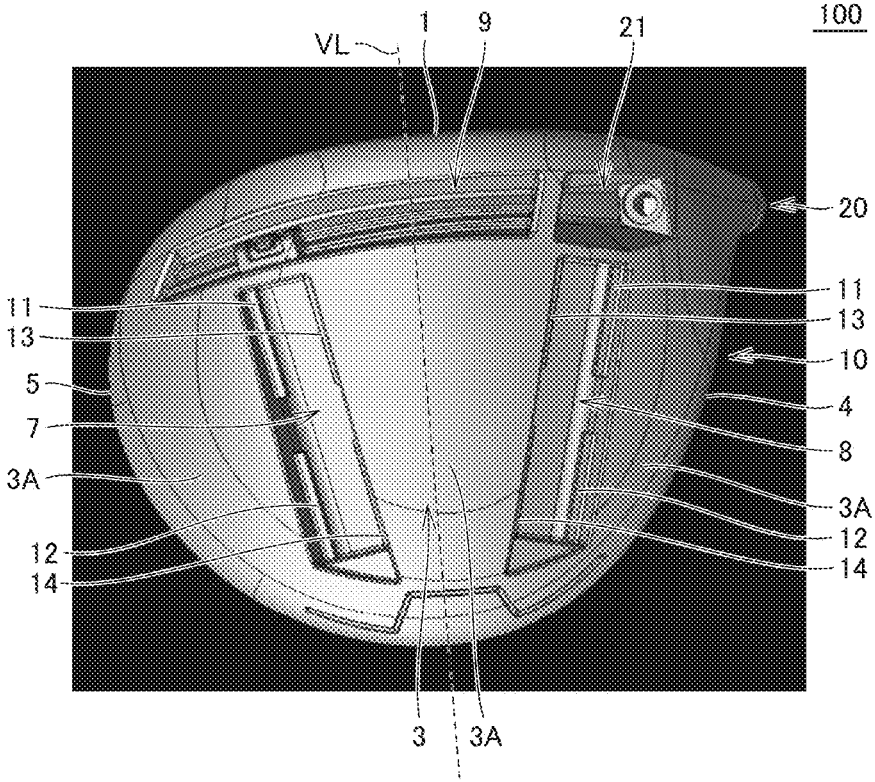
FIG. 9 is a bottom view seen along an arrow IX indicated in FIG. 1.

Note that FIG. 4 is a bottom view as seen along the arrow V shown in FIG. 1 and is a bottom view as seen in a direction perpendicular to bottom surface 75 of first guide track 7. FIG. 9 is a bottom view as seen along the arrow X shown in FIG. 1 and is a bottom view as seen in a direction perpendicular to a partial region 3A1 of sole surface 3A that is in contact with the horizontal plane in the above-defined placed state. As shown in FIG. 9, first guide track 7 and second guide track 8 are formed to sandwich partial region 3A1 of sole surface 3A that is in contact with the horizontal plane in the placed state. First guide track 7 and second guide track 8 are formed generally symmetrically with respect to an imaginary line VL which is orthogonal to ball striking face 1A and also passes through a sweet spot in a bottom view, for example. Weight 30 is accommodated in and attached to and detached from second guide track 8.

First track 9 is located between an end of sole 3 closer to ball striking face 1A and first guide track 7. First track 9 extends in the toe-heel direction. First track 9 has a fifth inner peripheral surface 91 directed toward ball striking face 1A and a sixth inner peripheral surface 92 facing fifth inner peripheral surface 91 and directed toward back 6.

Second track 21 is located between the end of sole 3 closer to ball striking face 1A and second guide track 8. Second track 21 is disposed so as to overlap hosel 20 in the depthwise direction. Second track 21 is spaced from first track 9 in the toe-heel direction.

A region in first track 9 on fifth inner peripheral surface 91 that is opposite to first guide track 7 in the longitudinal direction projects in the longitudinal direction toward face 1 as compared with another region adjacent to the opposite region in the toe-heel direction. In other words, golf club head 100 further includes a projection 40 that is accommodated inside first track 9 and disposed in a region opposite to first guide track 7 in the longitudinal direction of first guide track 7. Projection 40 is connected to fifth inner peripheral surface 91 of first track 9 and is spaced from sixth inner peripheral surface 92 of first track 9. Projection 40 is formed integrally with main body 10, for example. Projection 40 is formed for example of stainless steel. Projection 40 may be configured to be discrete from main body 10.

Figure 10:
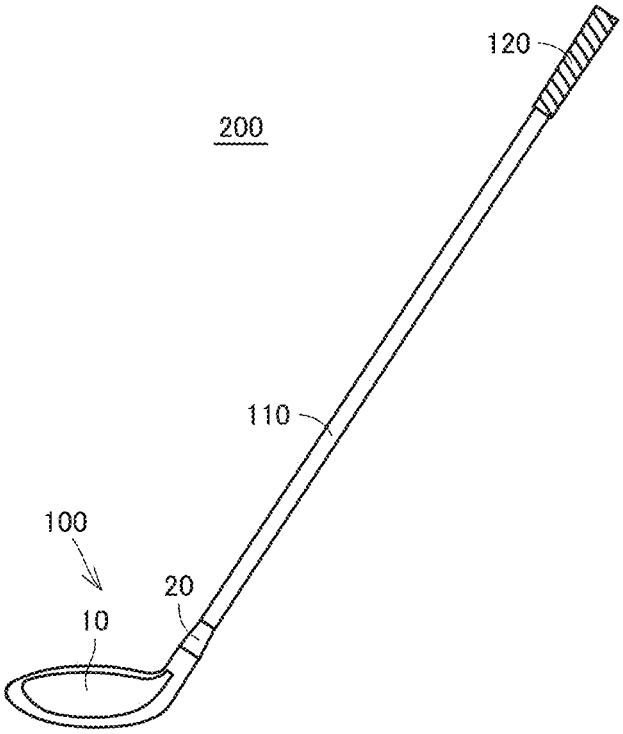
FIG. 10 is a perspective view of a golf club according to an embodiment.

As shown in FIG. 10, a golf club 200 includes golf club head 100, club shaft 110, and a grip 120. Club shaft 110 has one end attached to hosel 20 of golf club head 100. Club shaft 110 has the other end with grip 120 attached thereto.

<Function and Effect>

Golf club head 100 has sole 3 having first guide track 7 recessed with respect to sole surface 3A. First guide track 7 includes first inner peripheral surface 71 and second inner peripheral surface 72 that extend in the longitudinal direction and face each other in the lateral direction, third inner peripheral surface 73 and fourth inner peripheral surface 74 that extend in the lateral direction and face each other in the longitudinal direction, and first protrusion 11 and second protrusion 12 that protrude with respect to first inner peripheral surface 71 and extend in the longitudinal direction. Weight 30 is fitted to first protrusion 11 or second protrusion 12 in a state in which weight 30 is attached to first guide track 7. In golf club head 100, a position at which weight 30 is fixed is changed in the longitudinal direction intersecting with ball striking face 1A, and the position of the center of gravity of golf club head 100, and hence spin can be adjusted.

Second protrusion 12 is spaced from first protrusion 11 in the longitudinal direction. The distance L5 in the longitudinal direction between first protrusion 11 and second protrusion 12 is equal to or larger than the first width W1 of weight 30. Therefore, weight 30 attached to first guide track 7 is moved along first protrusion 11 or second protrusion 12, and thus disposed between first protrusion 11 and second protrusion 12 in the longitudinal direction and released from a state in which weight 30 is fitted to first protrusion 11 or second protrusion 12, and weight 30 is thus easily removed from first guide track 7. Similarly, when weight 30 is attached to first guide track 7, weight 30 is disposed between first protrusion 11 and second protrusion 12 in the longitudinal direction and subsequently moved along and fitted to first protrusion 11 or second protrusion 12, and thus easily attached to first guide track 7. That is, golf club head 100 allows weight 30 to be attached to and detached from first guide track 7 without assembling or disassembling weight 30.

Further, first protrusion 11 in the longitudinal direction has one end connected to third inner peripheral surface 73 and second protrusion 12 in the longitudinal direction has the other end connected to fourth inner peripheral surface 74. This allows weight 30 to be fixed in first guide track 7 at opposite ends in the longitudinal direction. That is, a maximum range in which a position at which weight 30 is fixed can be changed is equal to an entire length of first guide track 7 in the longitudinal direction. As a result, when golf club head 100 is compared with the conventional golf club head described above, the former can have a center of gravity adjusted in a wider range and hence allows spin to be adjusted in a wider range.

In golf club head 100, the longitudinal direction of first guide track 7 intersects with ball striking face 1A. The distance h5 in the depthwise direction between first protrusion 11 and bottom surface 75 is equal to the distance h7 in the depthwise direction between second protrusion 12 and bottom surface 75, and the distance h6 in the depthwise direction between first protrusion 11 and sole surface 3A is smaller than the distance h8 in the depthwise direction between second protrusion 12 and sole surface 3A.

In other words, when golf club head 100 is in the above-defined placed state, a maximum level of second protrusion 12 with respect to the horizontal plane is higher than that of first protrusion 11 with respect to the horizontal plane. Therefore, when weight 30 fixed at the end of first guide track 7 closer to back 6 is compared with weight 30 fixed at the end of first guide track 7 closer to face 1, the former is at a higher level with respect to the horizontal plane than the latter is.

This can increase a difference between a center of gravity of golf club head 100 with weight 30 fixed at the end of first guide track 7 closer to back 6 and a center of gravity of golf club head 100 with weight 30 fixed at the end of first guide track 7 closer to face 1. As a result, golf club head 100 allows spin to be adjusted in a wider range.

First guide track 7 of golf club head 100 further includes third protrusion 13 and fourth protrusion 14 in addition to first protrusion 11 and second protrusion 12. When weight 30 is attached to first guide track 7, weight 30 is further fitted to third protrusion 13 or fourth protrusion 14. Therefore, golf club head 100 fixes weight 30 in first guide track 7 more firmly than when first guide track 7 only has first protrusion 11 and second protrusion 12 and weight 30 is only fitted to first protrusion 11 or second protrusion 12. Further, golf club head 100 has third protrusion 13 and fourth protrusion 14 with a distance therebetween in the longitudinal direction equal to or larger than the first width W1 of weight 30, and thus allows weight 30 to be attached to and detached from first guide track 7 without assembling or disassembling weight 30.

Sole 3 of golf club head 100 further has second guide track 8 formed thereon in addition to first guide track 7. Weight 30 can also be accommodated in and attached to and detached from second guide track 8. When such golf club head 100 is compared with a golf club head with first guide track 7 formed alone, the former allows a center of gravity to be positionally adjusted in a wider range than the latter.

Sole 3 of golf club head 100 further has formed thereon first track 9 recessed with respect to sole surface 3A. First track 9 is located closer to face 1 than first guide track 7 is, and extends in the toe-heel direction. Therefore, face 1 of golf club head 100 is more flexible than when first track 9 is not formed. As a result, when golf club head 100 strikes a ball, face 1 can have a natural frequency set in a range that is not too low from the viewpoint of feel at impact and is not too high from the viewpoint of coefficient of restitution. Golf club head 100 thus coestablishes both a good feel at impact and a high coefficient of restitution.

Golf club head 100 may further include projection 40 that is accommodated inside first track 9 and fixed to a region opposite to first guide track 7 in the longitudinal direction of first guide track 7. When face 1 of such a golf club head 100 is compared with that of a golf club head without projection 40, the former has a higher natural frequency than the latter and hence provides a better feel at impact than the latter.

Golf club head 100 further includes hosel 20 formed integrally with main body 10 and connected to club shaft 110. Sole 3 further has formed thereon second track 21 recessed with respect to sole surface 3A. Second track 21 is spaced from first guide track 7, second guide track 8 and first track 9, and arranged to overlap hosel 20 in the depthwise direction.

Such a golf club head 100 allows that end of club shaft 110 connected to hosel 20 to be disposed inside second track 21. This facilitates attachment/detachment of that end of club shaft 110 inside second track 21 to/from a fixing member (not shown) for fixing club shaft 110 to golf club head 100. Furthermore, second track 21 is spaced from first guide track 7, second guide track 8 and first track 9, and when this is compared with second track 21 in communication with at least one of first guide track 7, second guide track 8 and first track 9, the former suppresses reduction in rigidity of sole 3 more than the latter.

In golf club head 100, a distance in the toe-heel direction between first guide track 7 and second guide track 8 gradually decreases as the tracks are farther away from ball striking face 1A in the direction intersecting with ball striking face 1A. In other words, first and second guide tracks 7 and 8 have their respective longitudinal directions intersecting with each other. From a different point of view, first and second guide tracks 7 and 8 have their respective longitudinal directions intersecting with respect to the face-back direction perpendicular to ball striking face 1A. Therefore, first and second guide tracks 7 and 8 of golf club head 100 each have an entire longitudinal length larger than those of first and second guide tracks 7 and 8 having their respective longitudinal directions along the face-back direction. As a result, golf club head 100 has a center of gravity adjusted in a wider range than a golf club head having first and second guide tracks 7 and 8 with their respective longitudinal directions along the face-back direction does.

The height h2 of back 6 with respect to the horizontal plane in the above-defined placed state is smaller than a half the maximum height h1 of golf club head 100 with respect to the horizontal plane. Golf club head 100 has first guide track 7 such that first guide track 7 in the longitudinal direction does not have an end formed as an opening, and golf club head 100 is thus suitable for a golf club head having such a shallow back shape as described above.

<Modification>

Note that insofar as weight 30 can be fixed at opposite ends of first guide track 7 in the longitudinal direction, one end of first protrusion 11 in the longitudinal direction may be spaced from third inner peripheral surface 73 in the longitudinal direction, and the other end of second protrusion 12 in the longitudinal direction may be spaced from fourth inner peripheral surface 74 in the longitudinal direction. In that case, a distance in the longitudinal direction between the one end of first protrusion 11 in the longitudinal direction and third inner peripheral surface 73 that is shorter than a distance in the longitudinal direction between the other end of first protrusion 11 in the longitudinal direction and one end of second protrusion 12 in the longitudinal direction and shorter than a width of weight 30 in the longitudinal direction, suffices.

While golf club head 100 has first guide track 7 having a longitudinal direction intersecting with ball striking face 1A, this is not exclusive. Golf club head 100 may have first guide track 7 having a longitudinal direction in the toe-heel direction. This case also allows a position at which a weight is fixed to be changed in the direction in which first guide track 7 extends, and can thus change spin (fade and draw in particular).

While golf club head 100 has first track 9 and second track 21 spaced from each other, this is not exclusive. Second track 21 may be connected to first track 9. In other words, a portion of first track 9 closer to heel 4 may overlap hosel 20 in the depthwise direction.

Golf club head 100 with sole 3 at least having first guide track 7 formed thereon suffices, and sole 3 may not have second guide track 8 formed thereon.

Sole 3 of golf club head 100 may have second guide track 8 replaced with a guide track having a structure different from first guide track 7. For example, the guide track may have the same configuration as a guide track of the conventional golf club head described above, and may have one end opened in a direction in which the guide track extends.

While golf club head 100 shown in FIGS. 1 to 9 is configured as a wood type golf club head, this is not exclusive, and the golf club head of the present embodiment is also applicable to a utility golf club head.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. A golf club head comprising:

a main body; and at least one weight attached to and detached from the main body, the main body including a face having a ball striking face, and a sole connected to the face and having a sole surface brought into contact with the ground when striking a ball, the sole having formed thereon at least one guide track recessed with respect to the sole surface and having a longitudinal direction and a lateral direction in a plan view, the at least one weight being fixed inside the at least one guide track, the at least one guide track including an attachment/detachment region in which the at least one weight is moved in a depthwise direction with respect to the sole surface and attached/detached, and a first fixing region and a second fixing region in which the at least one weight is moved in the longitudinal direction and fixed, the first and second fixing regions being arranged to be continuous to the attachment/detachment region in the longitudinal direction and also sandwich the attachment/detachment region, the first fixing region having one end of the at least one guide track in the longitudinal direction, the second fixing region having another end of the at least one guide track in the longitudinal direction, the at least one guide track has a first inner peripheral surface extending in the longitudinal direction, a first protrusion and a second protrusion protruding with respect to the first inner peripheral surface and extending in the longitudinal direction, a second inner peripheral surface extending in the longitudinal direction and facing the first inner peripheral surface in the lateral direction, a third inner peripheral surface and a fourth inner peripheral surface extending in the lateral direction and facing each other in the longitudinal direction, and a third protrusion and a fourth protrusion protruding with respect to the second inner peripheral surface and extending in the longitudinal direction, the first protrusion and the second protrusion are spaced from each other in the longitudinal direction, the third protrusion is spaced from the first protrusion in the lateral direction, the fourth protrusion is spaced from the second protrusion in the lateral direction and spaced from the third protrusion in the longitudinal direction, the first fixing region has the first protrusion and the third protrusion, the second fixing region has the second protrusion and the fourth protrusion, the at least one weight has a first recess that is fitted to the first protrusion when the at least one weight is fixed in the first fixing region and that is fitted to the second protrusion when the at least one weight is fixed in the second fixing region, and a second recess that is fitted to the third protrusion when the at least one weight is fixed in the first fixing region and that is fitted to the fourth protrusion when the at least one weight is fixed in the second fixing region, the attachment/detachment region is located in the longitudinal direction between the first protrusion and the second protrusion and between the third protrusion and the fourth protrusion, a distance in the longitudinal direction between the first protrusion and the second protrusion and a distance in the longitudinal direction between the third protrusion and the fourth protrusion are equal to or larger than a width of the at least one weight in the longitudinal direction, the longitudinal direction is a direction intersecting with the ball striking face, and a distance between the first protrusion and the sole surface is smaller than a distance between the second protrusion and the sole surface in the depthwise direction.

2. The golf club head according to claim 1, wherein the sole further has formed thereon a first track recessed with respect to the sole surface and located closer to the face than the at least one guide track is, the first track extends in a toe-heel direction and has an inner peripheral surface on a side of the at least one guide track, and a region of the inner peripheral surface of the first track that is opposite to the at least one guide track projects toward the face as compared with another region of the inner peripheral surface.

3. The golf club head according to claim 2, further comprising a hosel formed integrally with the main body and connected to a club shaft, wherein the sole further has formed thereon a second track recessed with respect to the sole surface, and the second track is spaced from the first track and the at least one guide track and formed to overlap the hosel in the depthwise direction.

4. The golf club head according to claim 1, further comprising a back, wherein when the golf club head is placed on a horizontal plane, the back has with respect to the horizontal plane a height smaller than a half of a maximum height of the golf club head with respect to the horizontal plane.

* * * * *